United States Patent [19]

Schroter

[11] 4,180,317

[45] Dec. 25, 1979

[54] APPARATUS FOR DEVELOPING SHEETS OF DIAZOTYPE COPYING MATERIAL BY THE SEMI-DRY PROCESS

[75] Inventor: Herbert Schröter, Taunusstein, Fed. Rep. of Germany

[73] Assignee: Hoechst Aktiengesellschaft, Fed. Rep. of Germany

[21] Appl. No.: 957,446

[22] Filed: Nov. 3, 1978

[30] Foreign Application Priority Data

Nov. 5, 1977 [DE] Fed. Rep. of Germany ..... 2749627

[51] Int. Cl.[2] ..... G03D 5/06

[52] U.S. Cl. ..... 354/318; 118/246; 118/249; 118/261

[58] Field of Search ..... 354/318, 319; 118/34, 118/246, 249, 261, 661

[56] References Cited

U.S. PATENT DOCUMENTS

| | | | |
|---|---|---|---|
| 2,605,684 | 8/1952 | Nagels et al. | 118/261 |
| 3,245,381 | 4/1966 | Brenneisen et al. | 118/661 |
| 3,418,912 | 12/1968 | Land et al. | 354/318 |
| 3,626,833 | 12/1971 | Koch | 354/318 |
| 3,748,996 | 7/1973 | Kobayashi | 354/318 |
| 3,875,581 | 4/1975 | Yamashita et al. | 354/318 |
| 3,995,585 | 12/1976 | Schuurmans | 354/318 |

FOREIGN PATENT DOCUMENTS

| | | | |
|---|---|---|---|
| 2209865 | 3/1972 | Fed. Rep. of Germany | 354/318 |

*Primary Examiner*—L. T. Hix
*Assistant Examiner*—Alan Mathews
*Attorney, Agent, or Firm*—James E. Bryan

[57] ABSTRACT

The invention is an improvement in an apparatus for developing sheets of diazotype copying material by the semi-dry process and includes at least two rotatable rolls being biased together with a gap between them for passage of the sheets of diazotype material, with an additional force being exerted on at least one of the rolls which force transfers a plane of deflection of one of the rolls to a position outside of a principal plane in which axes of the rolls are located in such a manner that a first line of intersection between the plane of deflection and the shell of the aforesaid one roll, starting from which line of intersection the deflection is directed toward the roll axis, extends in front of the gap, when viewed in the rotational direction of the roll, first guides to bring sheets of diazotype copying material into contact with the roll at a first transition line between the first line of intersection and the gap, and second guides to lift the sheets off of the roll behind the gap at a second transition line located before a second line of intersection between the plane of deflection and the aforesaid shell of the roll, starting from which second line of intersection the deflection is directed away from the roll axis.

4 Claims, 4 Drawing Figures

Figure 2:
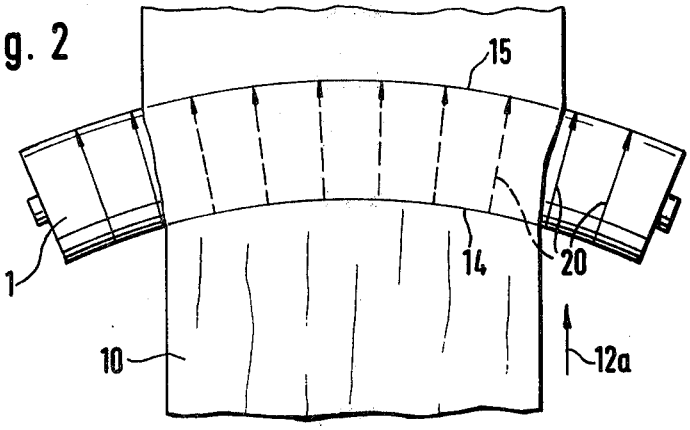

Fig. 1
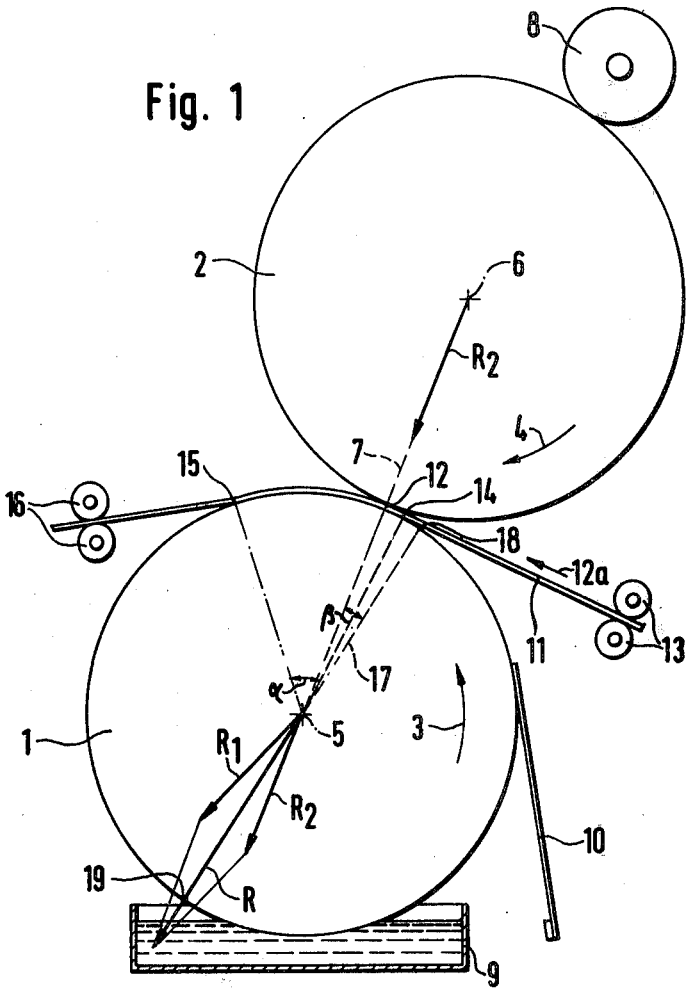
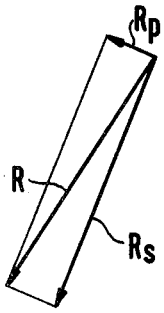
Fig. 1a

APPARATUS FOR DEVELOPING SHEETS OF DIAZOTYPE COPYING MATERIAL BY THE SEMI-DRY PROCESS

The present invention relates to an apparatus for developing sheets of diazotype copying material by the semi-dry process.

A developing apparatus of this type already has been disclosed in German Offenlegungsschrift No. 2,209,865; in this apparatus, three rolls are arranged side by side, in one plane, neighboring rolls being in contact with each other. The roll positioned at one end of the series is rotatably mounted in bearings which are fixedly mounted in one position, and the two other rolls are capable of displacement in the direction towards the roll next to them or away from it. In order to press the rolls upon each other, especially in the gap provided between two rolls, means are provided for exerting pressure upon that of the rolls which is in contact with the fixedly mounted rotatable roll at the other end of the series of rollers. This means is a press roll which rests against the free side of the squeeze roll and presses the squeeze roll, and simultaneously the rubber roll, against the backing roll. The press roll exerts its pressure on the squeeze roll in the medium range, viewed in an axial direction. The pressure exerted by the press roll causes the squeeze roll, the rubber roll, and the backing roll to be deflected along their entire lengths, the plane of deflection coinciding with the principal plane in which the axes of all rolls lie. Furthermore, an applicator wick made of felt, which serves as a means for applying and distributing the developer liquid, coacts with the rubber roll disposed in the middle of the roller arrangement.

The applicator wick is pressed by a spring against the middle rubber roll, so that an additional force acts on this roll which creates a deflection component not in the principal plane. This additional deflection is directed substantially opposite to the direction of feed of the diazotype copying material, which is passed through the roll gap along a straight path and thus contacts the rolls forming the gap only approximately in a line of contact.

By means of this known developing apparatus, a relatively uniform application of developer liquid is achieved on diazotype papers of relatively narrow width, but the sheets of diazotype copying material do not always pass the zone of application—which in this case is substantially identical with the gap between the rolls—without wrinkling. This fact is particularly annoying in the case of relatively wide sheets of papers.

The same problems may occur in the case of other prior art developing apparatus (U.S. Pat. No. 3,626,833), in which at least two rolls, which form a gap between them, are arranged vertically one above the other and in which a doctor blade or a scraper-like device comprising a bar is in contact with a roll which conveys the developing medium to the gap. The force exerted by the doctor blade or bar upon the roll is substantially directed in the direction of feed of the diazotype copying material to be developed, or, in the direction opposite to the direction of feed. In this case, also, the diazotype copying material is passed through the gap or the developing zone in a flat plane, so that the diazotype copying material and the rolls forming the gap contact each other practically only in a line of contact.

It is the object of the present invention, to provide a developing apparatus for developing sheets of diazotype copying material of the type described above, which also allows the passage of diazotype copying materials of relatively large sizes without the formation of wrinkles. Nevertheless, the uniform application of the developer medium with the necessary pressure is not affected.

The substantial advantage achieved by the present invention is that even relatively large-sized sheets of diazotype copying material, e.g. sizes DIN A0, DIN A1, and DIN A2, can be conveyed through the application zone without wrinkling.

In a developing apparatus of the design according to the present invention, this object is achieved by the fact that one of the rolls of the pair of rolls forming the gap, on which the sheet of diazotype copying material rests not in a line of contact, but in an area defined by a looping angle, is slightly curved in the direction of transport of the diazotype material. This deflection, however, is not caused exclusively by the second roll of the pair of rolls forming the gap, because in this case the diazotype copying material cannot contact the roll in a suitable place, viz. between the first line of intersection of the plane of deflection with the shell of the roll, and the gap. For this purpose, it is necessary that the means for exerting an additional force upon the roll—which if desired also may be the means for applying and distributing the developer liquid on the roll—are arranged in a manner such that the first line of intersection of the plane of deflection with the roll shell is positioned outside of the gap, i.e., before the gap when seen in the direction of rotation of the roll.

This means at the same time that the resultant of the forces acting upon this roll form an angle with the principal plane, i.e. the plane comprising all the axes of the rolls. The feature that, when viewed in the direction of rotation of the rolls, the first line of intersection is positioned in front of the gap, means, at the same time, that the resultant of the forces acting upon this roll must have a force component extending in the plane of the gap through which the copying material passes, i.e. at a right angle to the principal plane, the direction of which corresponds to the direction of the transport of the diazotype copying material.

A particularly advantageous embodiment of the developing apparatus according to the present invention is so designed that the looping angle formed by the sheet of diazotype copying material between the first and the second lines of transition is less than 90°.

In this manner, an unwrinkled passage of the diazotype material is particularly reliably achieved, because, on the one hand, the diazotype copying material thus travels with the roll over a relatively long distance and is subjected to a slight transverse stretching during that time, while, on the other hand, the first and second lines of contact are within safe distance from the boundary lines which, when passed, could reverse the desired effect and turn it into its opposite. These boundary lines are the first and second lines of intersection with the shell and are separated from each other by an angle of 180°. The term "looping angle" is used in the normal manner to designate the angle which includes the lines of transition, as seen from the axis of the roller.

In a further embodiment of the developing apparatus according to the invention, which is particularly advantageous, the plane of deflection forms an angle of less than 22.5° with the plane which comprises the axes of the rolls.

In this manner, the deflection is substantially caused by the contact pressure between the two rolls which is necessary for a good and uniform application of the developer medium. The deflection, which postulates a deflection component in the direction of feed of the diazotype material, need not be very substantial to achieve the desired result. In this manner, the roll is not subjected to undue stress. Moreover, this design permits a particularly compact arrangement.

In order to achieve a uniform application of the developer medium although using a developing apparatus which is particularly designed for a wrinkle-free passage of the diazotype copying material, the developing apparatus equipped with two rolls which substantially are arranged one above the other, has the additional feature that the deflection component of the upper roll in the principal plane comprising the roller axes exceeds the deflection component of the lower roll in this plane, so that the two rolls are in contact with each other over their entire width. With this design, which refers to the resultant of the partial forces in the principal plane, a uniform contact of the two rolls along their line of contact is achieved even if their maximum deflection is not in the principal plane.

Figure 3:
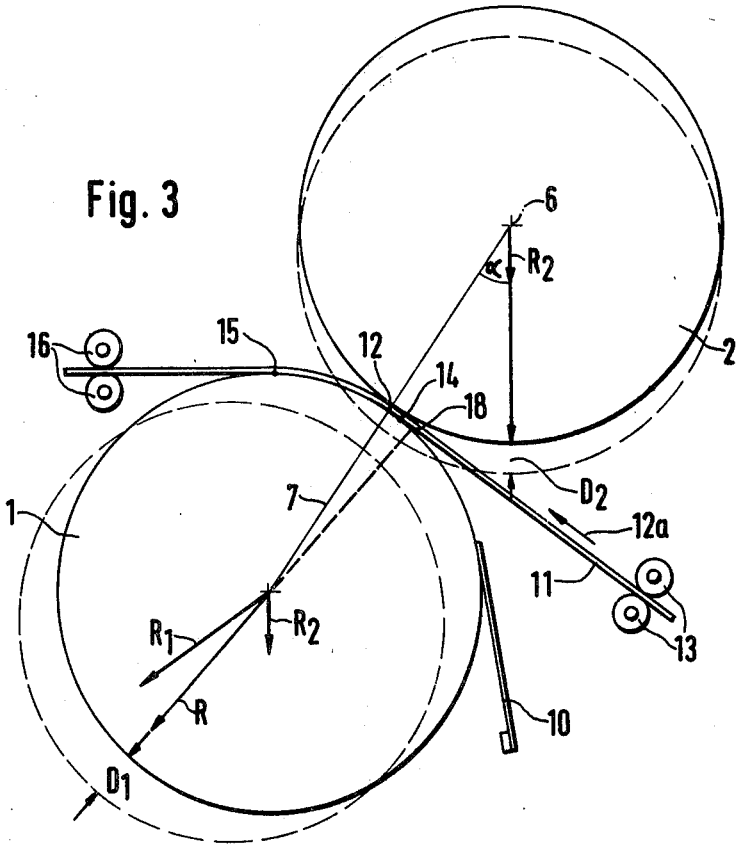

Several embodiments of the invention are described in the following by reference to the figures of the drawing:

In the drawings:

FIG. 1 is a side view of the first embodiment of the developing apparatus according to the invention in which the pair of rolls is diagrammatically represented, FIG. 1*a* is the line of application of the resultant force of FIG. 1, FIG. 2 is a top view of one of the rolls of the developing apparatus according to FIG. 1, in which the deflection is exaggerated, and FIG. 3 is a side view of another modification of the developing apparatus according to the invention in which the rolls are represented diagrammatically.

In FIG. 1, numeral 1 designates a lower applicator roll which forms a pair of rolls with the upper backing roll 2. The two rolls are rotatable in the direction of the arrows 3, 4 and the axes of the two rolls 5, 6 lie in the principal plane 7. A press roll 8 presses on the upper backing roll 2; when viewed in the axial direction, the press roll contacts the middle of the backing roll. The lower applicator roll dips into a container 9 which contains a liquid developer medium. Furthermore, a doctor blade 10, which serves for dosing the developer medium removed from the container, exerts a lateral pressure upon the applicator roll. The shell of the applicator roll may be of rubber, whereas the surface of the backing roll may be of metal.

The principal plane of the two rolls which comprises the axes 5 and 6 of the rolls, forms an angle with the vertical plane; this may be of advantage for guiding the sheet-like diazotype copying material 11 to be developed. The diazotype copying material is passed to the gap 12, where the rolls 1 and 2 are compressed so that they approximately meet in the line of contact. A pair of guide rollers 13, which serve as the first guide means, deflect the diazotype copying material 11 conveyed in the direction 12*a* in such a manner to the applicator roll 1, that it meets the shell of the roll 1 in the first transition line 14. After passage through the gap 12, the diazotype copying material is lifted from the applicator roll in the second transition line 15, which is effected by the position of the guide rollers 16.

In FIG. 1, the arrow $R_2$ shows the line of application of the resultant force which is exerted upon the backing roll 2 by the weight of the roll 2 and by the additional force exerted by the press roll 8. This line of application extends in the principal plane 7. The lower applicator roll is acted upon by the resultant force $R_2$, and, in addition thereto, by a resultant force $R_1$ composed of the weight of the applicator roll and the additional force exerted by the doctor blade 10 upon the applicator roll. The resultant force $R_1$ does not extend in the principal plane 7, but is swivelled relative thereto, so that the total resultant force R formed by the forces $R_1$ and $R_2$ also extends outside of the principal plane. This total resultant force R causes a deflection of the applicator roll 1, the deflection lying in the plane of deflection 17. The plane of deflection intersects the shell of the applicator roll 1 in a first line of intersection 18 and a second line of intersection 19.

As shown in FIG. 1, it is essential that the diazotype copying material 11 contacts only the shell of the applicator roll after having passed the first line of intersection 18, in the first transition line 14—as viewed in the direction of feed 12*a* or in the direction of rotation 3, and that it is removed from the shell before reaching the second line of intersection 19, in the transition line 15.

As can be seen from FIG. 1*a*, there is, in the configuration of the resulting total force R, a second component, in addition to the first component $R_s$ extending in the principal plane, which acts at a right angle to the first component and extends in the plane of the gap in the direction 12*a* in which the diazotype copying material is passed through the gap.

FIG. 2 shows how wrinkling of the material is avoided by the roll deflected by the influence of the resultant total force R, the roll having not only a deflection component in the principal plane, but also a deflection component in the direction of feed, due to the force component $R_p$. If the diazotype copying material meets the applicator roll in the first transition line 14 and is lifted from it at the second transition line 15, it is stretched in the area between these transition lines, as indicated by the diverging arrows 20.

FIG. 3 shows a developing apparatus which resembles that of FIG. 1, corresponding parts being designated by the same reference numbers. In contradistinction to the developing apparatus of FIG. 1, the embodiment shown in FIG. 3 does not include a press roll 8, so that the backing roll 2 is merely deflected by the influence of its own weight which acts in the direction $R_2$, the maximum deflection $D_2$ lying vertically below the axis 6.

The applicator roll, on the other hand, has its maximum deflection $D_1$ in the direction of the resultant total force R, which is approximately in the same place as in FIG. 1. The forces acting upon the rolls 1 and 2 are so dimensioned that the deflection of the roll 2 in the principal plane 7 exceeds the deflection of the roll 1, likewise in the principal plane 7, so that the rolls 1 and 2 lie upon each other in a line of contact 12 extending over their entire length.

In FIG. 1, the angle of loop between the first and the second transition lines is designated by $\alpha$, whereas the angle between the principal plane and the plane comprising the resulting total force is designated by $\beta$.

In an advantageous embodiment, the developing apparatus according to the invention is distinguished by the feature that one of the two rolls which are compressed, viz. the applicator roll, is provided with a fluid-absorbing elastic cover, and that the other of the two rolls, i.e. the backing roll, has a grooved, hard surface. If a quantity of developer solution corresponding to an area weight of 3 to 5 g/m$^2$ is to be applied, the elastic cover on the applicator roll preferably is styrene/-butadiene copolymer and has a peak-to-valley height of 13 to 15 $\mu$m.

It will be obvious to those skilled in the art that many modifications may be made within the scope of the present invention without departing from the spirit thereof, and the invention includes all such modifications.

What is claimed is:

1. In an apparatus for developing sheets of diazotype copying material by the semi-dry process comprising an arrangement of at least two rolls, each of which is rotatable about an axis, means biasing two rolls together with a gap between them through which said sheets of diazotype material to be developed are adapted to pass, means for exerting an additional force upon at least one of said two rolls, and means for applying and spreading liquid developer on one of said two rolls, the improvement comprising that said means for exerting an additional force transfers a plane of deflection of one of said rolls to a position outside of a principal plane in which said roll axes are located in a manner such that a first line of intersection between said plane of deflection and the shell of said one roll, starting from which line of intersection the deflection is directed toward said roll axis, extends in front of said gap, when viewed in the rotational direction of said roll, first guide means adapted to bring said sheets of diazotype copying material into contact with said roll at a first transition line between said first line of intersection and said gap, and second guide means adapted to lift said sheets off of said roll behind said gap at a second transition line located before a second line of intersection between said plane of deflection and said shell of said roll, starting from which second line of intersection the deflection is directed away from said roll axis.

2. Apparatus according to claim 1 in which an angle of loop formed by the sheets of diazotype copying material between the first transition line and the second transition line is less than 90°.

3. Apparatus according to claim 1 in which the plane of deflection forms an angle of less than 22.5° with the principal plane in which the roll axes are located.

4. Apparatus according to claim 1 in which the two rolls are arranged substantially one above the other, and the deflection component of the upper roll in the principal plane exceeds the deflection component of the lower roll in this plane, so that the two rolls contact each other over the entire width thereof.

* * * * *